US007913417B2

(12) United States Patent
Patka, Sr. et al.

(10) Patent No.: US 7,913,417 B2
(45) Date of Patent: Mar. 29, 2011

(54) SYSTEM AND METHOD TO CONTROL ENERGY INPUT TO A MATERIAL

(75) Inventors: John J. Patka, Sr., Seven Hills, OH (US); Sharon L. Judge, Dallas, TX (US)

(73) Assignee: The Sherwin-Williams Company, Cleveland, OH (US)

( * ) Notice: Subject to any disclaimer, the term of this patent is extended or adjusted under 35 U.S.C. 154(b) by 493 days.

(21) Appl. No.: 11/562,593

(22) Filed: Nov. 22, 2006

(65) Prior Publication Data

US 2007/0175061 A1 Aug. 2, 2007

Related U.S. Application Data

(60) Provisional application No. 60/739,693, filed on Nov. 23, 2005.

(51) Int. Cl.
*F26B 3/34* (2006.01)

(52) U.S. Cl. ..... 34/259; 34/265; 34/218; 700/1; 700/2; 117/951; 524/832; 426/243; 427/385.5; 219/756; 219/678

(58) Field of Classification Search ..... 34/259, 34/265, 218; 117/951; 524/832; 700/1, 700/2; 426/243; 427/385.5; 219/756, 678
See application file for complete search history.

(56) References Cited

U.S. PATENT DOCUMENTS 3,860,818 A * 1/1975 Stalder et al. ..... 250/343
3,923,697 A * 12/1975 Ellis ..... 252/506
3,955,286 A * 5/1976 Anrep ..... 34/263
4,180,918 A 1/1980 Ostrowski
4,303,818 A 12/1981 Smith
4,347,065 A * 8/1982 Gans ..... 95/282
4,508,640 A * 4/1985 Kanda et al. ..... 252/503
4,765,773 A * 8/1988 Hopkins ..... 404/94
4,778,970 A * 10/1988 Klaila ..... 219/697
5,079,398 A * 1/1992 Kuziemka et al. ..... 219/730
5,087,645 A * 2/1992 Kojima et al. ..... 523/406
5,108,677 A * 4/1992 Ayres ..... 264/112
5,120,570 A * 6/1992 Boaz ..... 427/541
5,139,826 A * 8/1992 Kuziemka et al. ..... 427/380
(Continued)

FOREIGN PATENT DOCUMENTS

CH 680948 A * 12/1992
(Continued)

*Primary Examiner* — Stephen M. Gravini
(74) *Attorney, Agent, or Firm* — Vivien Y. Tsang; Robert E. McDonald; Deron A. Cook

(57) ABSTRACT

A system and method of controlling energy that is input to a material substance, for the controlled removal of moisture from the material substance, is disclosed. A controlled air flow is blown onto the material substance at a specified air flow rate over at least one specified time period such that the material substance absorbs thermal energy from the controlled air flow via at least one outer surface of the material substance. The controlled air flow is of a specified humidity level at a specified temperature level. The material substance is also irradiated with microwave energy at a first specified power level for at least a first specified time duration such that the material substance absorbs at least a part of the microwave energy and converts the absorbed microwave energy to thermal energy within the material substance. As a result, moisture is removed from the material substance in a controlled manner.

30 Claims, 4 Drawing Sheets

U.S. PATENT DOCUMENTS

| | | | | |
|---|---|---|---|---|
| 5,424,518 | A * | 6/1995 | Gustafsson | 219/757 |
| 5,509,956 | A * | 4/1996 | Opperman et al. | 95/109 |
| 5,512,734 | A * | 4/1996 | Copstead | 219/679 |
| 5,538,681 | A | 7/1996 | Wu | |
| 5,578,753 | A | 11/1996 | Weiss et al. | |
| 5,631,685 | A * | 5/1997 | Gooray et al. | 347/102 |
| 5,886,326 | A * | 3/1999 | Tang | 219/679 |
| 5,950,325 | A * | 9/1999 | Mehdizadeh et al. | 34/256 |
| 5,954,970 | A * | 9/1999 | St. Louis | 210/710 |
| 5,974,687 | A * | 11/1999 | Gante et al. | 34/265 |
| 5,980,962 | A | 11/1999 | Bracken et al. | |
| 6,029,467 | A * | 2/2000 | Moratalla | 62/271 |
| 6,143,221 | A * | 11/2000 | Gurol | 264/118 |
| 6,225,611 | B1 * | 5/2001 | Pearcy et al. | 219/679 |
| 6,270,708 | B1 * | 8/2001 | Gurol | 264/117 |
| 6,323,470 | B2 * | 11/2001 | Schmidt et al. | 219/679 |
| 6,536,133 | B1 * | 3/2003 | Snaper | 34/265 |
| 6,546,646 | B1 | 4/2003 | Thomas | |
| 6,675,495 | B2 * | 1/2004 | Dedieu et al. | 34/245 |
| 6,938,358 | B2 * | 9/2005 | Lyle et al. | 34/265 |
| 7,148,455 | B2 * | 12/2006 | Scalese et al. | 219/679 |
| 7,665,227 | B2 * | 2/2010 | Wright et al. | 34/339 |
| 2004/0000069 | A1 * | 1/2004 | Gurol | 34/592 |
| 2005/0066537 | A1 * | 3/2005 | Kahner et al. | 34/90 |
| 2005/0116388 | A1 | 6/2005 | Richeson | |
| 2007/0175061 | A1 * | 8/2007 | Patka et al. | 34/265 |
| 2007/0295716 | A1 * | 12/2007 | Quantrille et al. | 219/678 |
| 2008/0263890 | A1 * | 10/2008 | Picard | 34/282 |
| 2008/0263891 | A1 * | 10/2008 | Brunet | 34/396 |
| 2009/0302030 | A1 * | 12/2009 | Quantrille et al. | 219/678 |
| 2010/0249320 | A1 * | 9/2010 | Matsumoto et al. | 524/832 |

FOREIGN PATENT DOCUMENTS

| | | | | |
|---|---|---|---|---|
| CH | 680948 | A5 | * | 12/1992 |
| EP | 429951 | A2 | * | 6/1991 |
| EP | 490491 | A2 | * | 6/1992 |
| EP | 695727 | A1 | * | 2/1996 |
| EP | 1396695 | A2 | * | 3/2004 |
| JP | 54107877 | A | * | 8/1979 |
| JP | 58049757 | A | * | 3/1983 |
| JP | 63123470 | A | * | 5/1988 |
| JP | 06338711 | A | * | 12/1994 |
| JP | 09111160 | A | * | 4/1997 |
| JP | 11021127 | A | * | 1/1999 |
| JP | 2002188117 | A | * | 7/2002 |
| WO | WO 9002613 | A1 | * | 3/1990 |

* cited by examiner

SYSTEM AND METHOD TO CONTROL ENERGY INPUT TO A MATERIAL

CROSS-REFERENCE TO RELATED APPLICATION

This application claims the benefit of U.S. provisional patent application No. 60/739,693 filed on Nov. 23, 2005, the entirety of which is hereby incorporated by reference.

TECHNICAL FIELD

Certain embodiments of the present invention relate to transferring energy to a material substance. More particularly, certain embodiments of the present invention relate to a system and method to transfer thermal energy and microwave energy to a material substance for the purpose of removing moisture from the material substance in a controlled manner to affect, for example, a desirable characteristic of the material substance, such as color appearance of the material substance.

BACKGROUND OF THE INVENTION

Many times in industry, processes are needed for removing moisture from material substances. For example, in the paint industry during the manufacturing of paint, quality control procedures are implemented to check the true colors of paints against standard reference colors. However, it is well known that, when wet, light colored paints appear darker and dark colored paints appear lighter than when the paint is dry. That is, wet paint does not reflect the true color of the paint in a dried state. Therefore, it is desirable for a sample film of paint on a test panel to be dry before testing for color.

In a production environment, where samples of paint are frequently being checked for color, it is desirable to be able to dry the sample paint films as quickly as possible without having the paint films crack or bubble, and without locking moisture inside the paint films. The colors of paint films which have moisture locked inside look different than paint films which are thoroughly dry, even though the outside surface of the paint film may be dry.

Parameters such as temperature and humidity greatly affect how paint films dry. Also, different paint formulas tend to react differently to different temperature and humidity conditions when drying. It is desirable, therefore, to develop a system and method for removing moisture from material substances such as, for example, paint films in an accelerated, controlled, and repeatable manner to maintain quality control of, for example, the color appearance of the material substance. This system must be capable of reproducible results that are unaffected by atmospheric conditions.

Further limitations and disadvantages of conventional, traditional, and proposed approaches will become apparent to one of skill in the art, through comparison of such systems and methods with the present invention as set forth in the remainder of the present application with reference to the drawings.

BRIEF SUMMARY OF THE INVENTION

An embodiment of the present invention comprises a method of controlling energy that is input to a material substance for the controlled removal of moisture from the material substance. The method comprises blowing a controlled air flow onto the material substance, wherein the controlled air flow has a specified humidity level at a specified temperature level, at a specified air flow rate over at least one specified period of time such that the material substance absorbs thermal energy from the controlled air flow via at least one outer surface of the material substance thereby causing at least the at least one outer surface to lose moisture in a controlled manner. The method further comprises irradiating the material substance with microwave energy at a first specified power level for at least a first specified time duration such that the material substance absorbs at least a part of the microwave energy and converts the absorbed microwave energy to thermal energy within the material substance, thereby causing at least an internal volume of the material substance to lose moisture in a controlled manner.

A further embodiment of the present invention comprises a system for controlling energy that is input to a material substance for the controlled removal of moisture from the material substance. The system comprises a cooling/de-humidification subsystem for accepting ambient air and for decreasing a temperature level and/or a humidity level of the ambient air to produce a relatively dry and cool pre-conditioned air. The system further comprises a heating/humidification subsystem operationally connected to the cooling/de-humidification subsystem to accept the pre-conditioned air and to add thermal energy and moisture to the preconditioned air to produce a controlled air having a specified humidity level at a specified temperature level. The system also comprises an energy transfer chamber operationally connected to the heating/humidification subsystem to accept the controlled air such that the controlled air passes across a material substance within the energy transfer chamber and transfers thermal energy from the controlled air to the material substance, thereby causing at least one outer surface of the material substance to lose moisture in a controlled manner. The system further comprises a variable power microwave source operationally connected to the energy transfer chamber to provide microwave energy into the energy transfer chamber such that the material substance may absorb at least a part of the microwave energy and convert the absorbed microwave energy to thermal energy within the material substance, thereby causing at least an internal volume of the material substance to lose moisture in a controlled manner.

Another embodiment of the present invention comprises a method of controlling energy that is input to a material substance for the controlled removal of moisture from the material substance. The method includes providing an in-bound ambient air volume flowing at a specified flow rate. The method further includes reducing a temperature level and/or a humidity level of the flowing in-bound ambient air volume to form a flowing pre-conditioned air volume. The method also includes increasing a temperature level and/or a humidity level of the flowing pre-conditioned air volume to a specified humidity level at a specified temperature level to form a flowing controlled air volume containing the desired thermal energy and moisture than the pre-conditioned air volume. The method further includes directing the flowing controlled air volume across a material substance which contains moisture such that at least a part of the thermal energy within the flowing controlled air volume is absorbed by the material substance to reduce the moisture on at least an outer surface of the material substance. The method also includes irradiating the material substance with microwave energy such that at least a part of the microwave energy is absorbed within the material substance to reduce the moisture within the material substance.

Certain embodiments of the present invention maintain consistency and repeatability between drying runs of the material substance (e.g., wet paint) under the same test conditions and between multiple systems in use at either the same or different locations. Optimal evaporation rates are achieved from both outside and inside the material substance. Thus, in accordance with various embodiments of the present invention, by controlling the parameters (e.g., temperature, humidity, flow rate, time period) of the controlled air, and by controlling the parameters (e.g., power level, time duration) of the microwave energy, the moisture content of a material substance may be regulated and/or accelerated in a controlled manner to achieve desirable characteristics consistently and reliably. For example, a specified appearance characteristic, such as a dried paint color, can be achieved in an accelerated and controlled manner.

These and other advantages and novel features of the present invention, as well as details of illustrated embodiments thereof will be more fully understood from the following description and drawings.

DETAILED DESCRIPTION OF THE INVENTION

Figure 1:
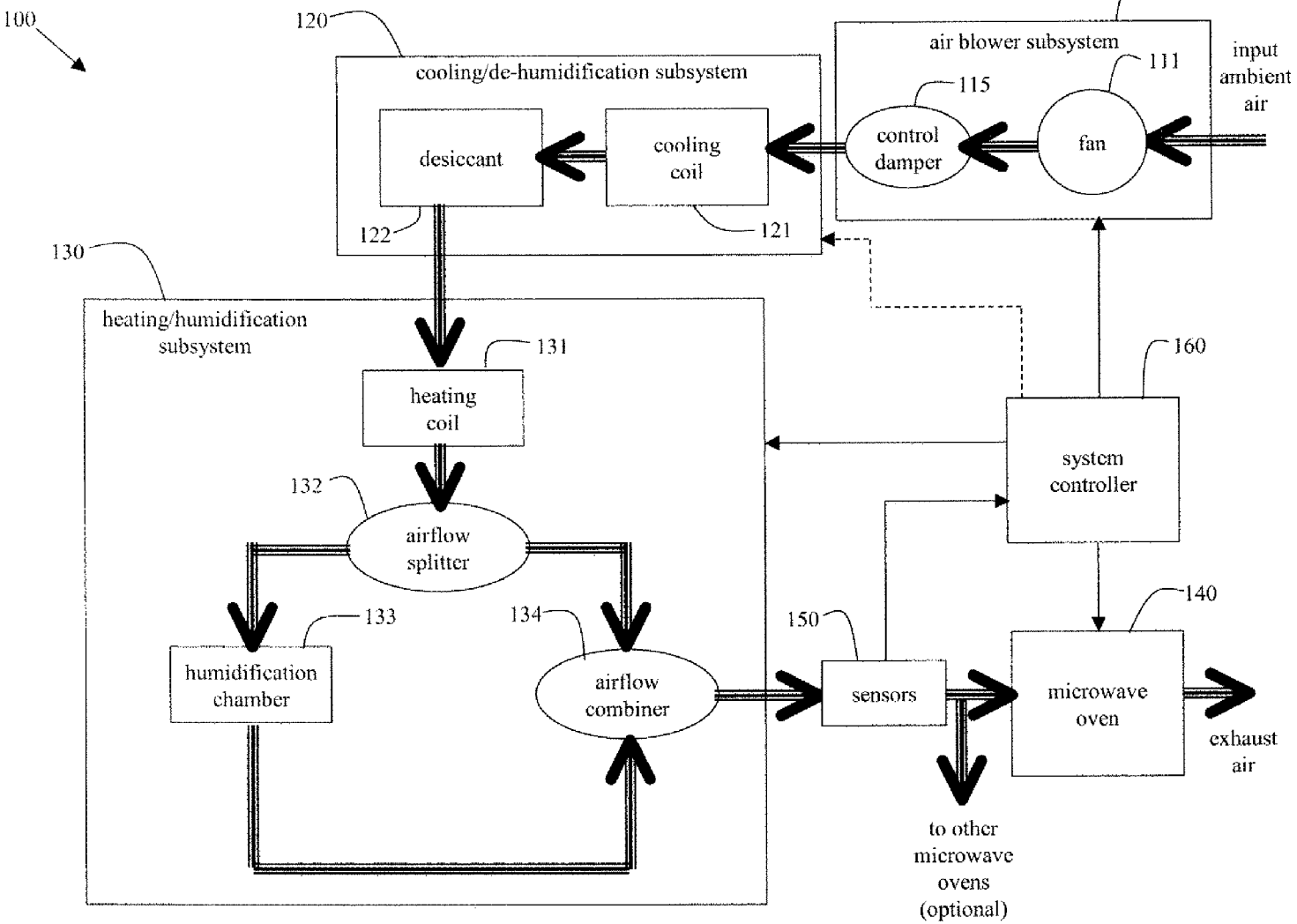
FIG. 1 illustrates a schematic block diagram of an exemplary embodiment of a system for controlling energy that is input to a material substance, in accordance with various aspects of the present invention.

FIG. 1 illustrates a schematic block diagram of an exemplary embodiment of a system 100 for controlling energy that is input to a material substance, in accordance with various aspects of the present invention. The system 100 includes an air blower subsystem 110 to blow ambient air into the system 100 and to control the flow rate of air within the system 100. In accordance with an embodiment of the present invention, the air blower subsystem 110 includes a fan ill and a control damper 115. The system 100 further includes a cooling/de-humidification subsystem 120 operationally connected to the air blower subsystem 110 for accepting ambient air and decreasing a temperature level and/or a humidity level of the ambient air to produce a pre-conditioned air which is relatively dry and cool. In accordance with an embodiment of the present invention, the cooling/de-humidification subsystem 120 includes a cooling coil 121 and a desiccant 122.

The system 100 also includes a heating/humidification subsystem 130 operationally connected to the cooling/de-humidification subsystem 120 to accept the pre-conditioned air and to add thermal energy and moisture to the pre-conditioned air to produce a controlled air having a specified humidity level at a specified temperature level. In accordance with an embodiment of the present invention, the heating humidification subsystem 130 includes a heating source 131, an airflow splitter 132, a humidification chamber 133, and an airflow combiner 134. The heating source 131 may comprise an electric heating coil and the humidification chamber may include a water spraying mechanism and/or wet sponges, in accordance with an embodiment of the present invention.

The pre-conditioned air enters the heating source 131 where thermal energy is added to the pre-conditioned air. The heated air out of the heating source 131 then enters the airflow splitter 132 and is split off into two branches. The airflow splitter 132 may comprise a simple 3-port duct work, for example, which diverts the heated air through and around the humidification chamber. A first branch goes to the humidification chamber 133 to increase the humidity level of the heated air. The heated humidified air then goes to the airflow combiner 134. The second branch goes directly to the airflow combiner 134. The heated/humidified air from the humidification chamber 133 and the dry heated air from the airflow splitter 131 are blended in the airflow combiner 134 in such a way so as to generate a controlled air out of the heating/humidification subsystem 130 of a specified humidity level at a specified temperature level. The airflow combiner 134 may comprise duct work having controllable valves or dampers, for example, for mixing the two streams of air in a desired ratio or blend.

The system 100 further comprises a microwave oven 140 which acts as an energy transfer chamber and a variable power microwave source. The microwave oven 140 accepts the controlled air from the heating/humidification subsystem 130. The microwave oven 140 may include a turntable on which a material substance may be placed and rotated for better uniformity of microwave irradiation of the material substance. In accordance with an embodiment of the present invention, the microwave source within the microwave oven 140 is not cycled on and off over a specified time duration. Instead, the power level of the microwave energy provided by the microwave source is adjusted to a specified level for a specified time duration. In accordance with an embodiment of the present invention, the variable power microwave source comprises an adjustable magnetron. The microwave oven 140 may have an multistage timer system to allow multiple periods of heating or cooling each with unique levels of microwave power to effect optimal material preparation.

The system 100 also includes sensors 150 in the airflow path between the heating/humidification subsystem 130 and the microwave oven 140 to measure the temperature level, the humidity level, and the flow rate of the controlled air. In accordance with an embodiment of the present invention, the sensors 150 may include a thermistor, a humidistat, and an air flow sensor. Other types of sensor are possible as well, in accordance with various alternative embodiments of the present invention.

The system 100 also includes a system controller 160 which operationally interfaces to the air blower subsystem 110 to control the rate of airflow through the system 100. The system controller 160 also operationally interfaces to the heating/humidification subsystem 130 to control the resultant temperature level and humidity level of the controlled air out of the airflow combiner 134 of the heating/humidification subsystem 130. The system controller 160 further operationally interfaces to the microwave oven 140 to control a power level of microwave energy produced by the variable power microwave source of the microwave oven 140 and a time duration over which the microwave energy is produced and dispersed within the microwave oven 140. In accordance with various embodiments of the present invention, the system controller 160 may comprise a programmable computer-based platform such as a personal computer, for example. Other computer-based platforms are possible as well.

In accordance with an alternative embodiment of the present invention, any or all of the subsystems 110, 120, 130, and 140 are controlled and set manually instead of via a system controller.

The cooling/de-humidification subsystem 120 is, typically, permanently set to output pre-conditioned air at a predefined temperature and humidity level. However, as an option, the system controller 160 may also operationally interface to the subsystem 120 to dynamically control the temperature and humidity levels of the pre-conditioned air.

Figure 2:
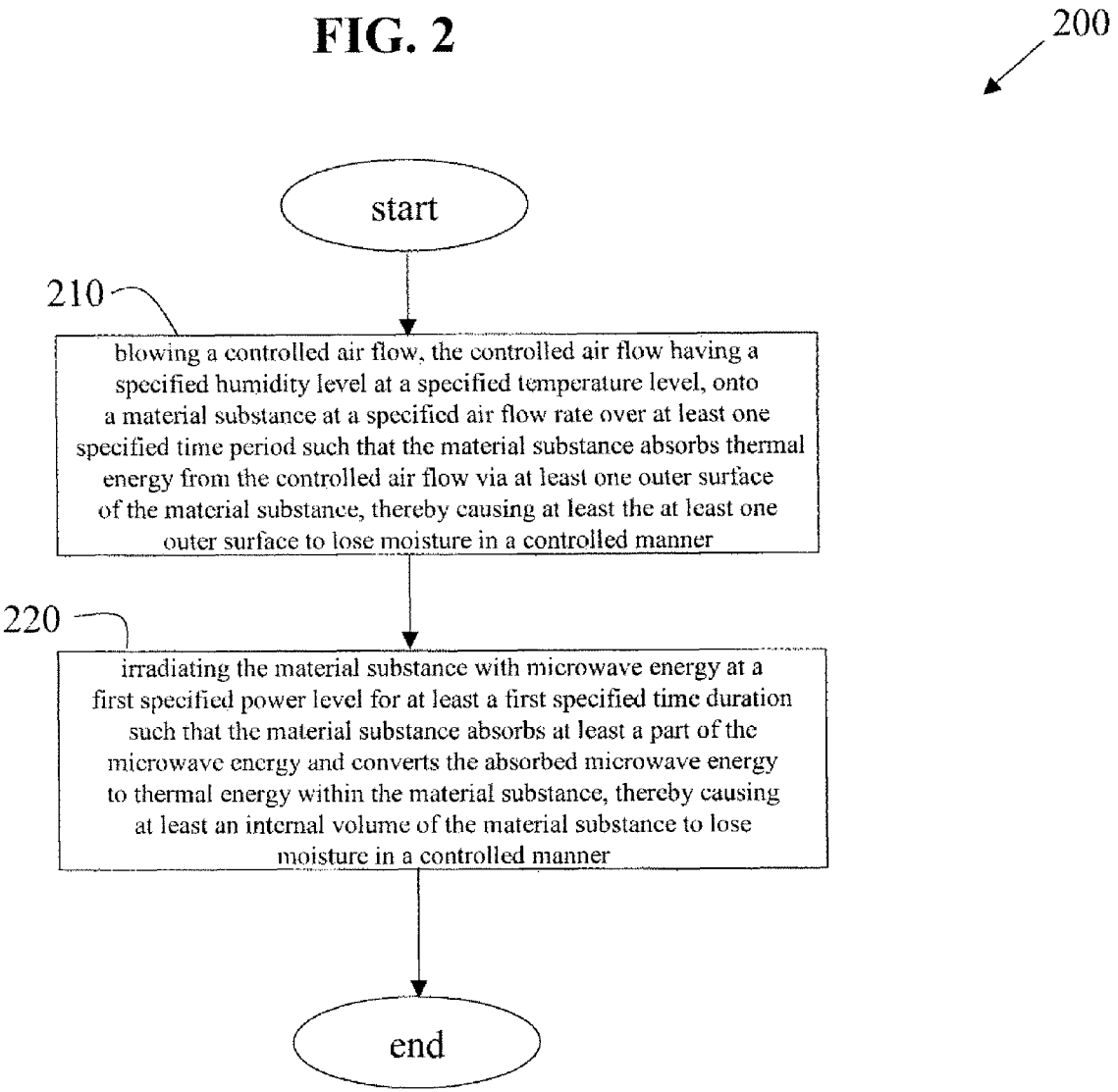
FIG. 2 is a flowchart of an exemplary embodiment of a method of controlling energy that is input to a material substance, in accordance with various aspects of the present invention.

FIG. 2 is a flowchart of an exemplary embodiment of a method 200 of controlling energy that is input to a material substance, in accordance with various aspects of the present invention. In step 210, a controlled air flow is blown onto a material substance at a specified air flow rate over a specified time period such that the material substance absorbs thermal energy from the controlled air flow via at least one outer surface of the material substance, thereby causing at least the at least one outer surface to lose moisture in a controlled manner. The controlled air flow is of a specified temperature level and a specified humidity level. In step 220, the material substance is irradiated with microwave energy at a first specified power level for at least a first specified time duration such that the material substance absorbs at least a part of the microwave energy and converts the absorbed microwave energy to thermal energy within the material substance, thereby causing at least an internal volume of the material substance to lose moisture in a controlled manner. For example, if the material substance is a wet film of paint, the wet film of paint will dry, using the method 200 of FIG. 2, such that the desired final color of the dried film of paint is achieved, and such that the dried film of paint is not cracked, blistered, or bubbled (i.e., the desired appearance characteristics are achieved).

In accordance with an embodiment of the present invention, a panel (e.g., a flat paper sheet known as a Leneta chart) having a film of wet paint (i.e., a material substance) deposited on the panel is placed into the microwave oven 140. The system controller 160 turns on the air blower subsystem 110 to produce an ambient air flow into the cooling/de-humidification subsystem 120 of 75 cubic feet per minute (CFM). The cooling/de-humidification subsystem 120 decreases the temperature level of the ambient air to 40 degrees F and decreases the humidity level of the ambient air to 1% relative humidity at 40 degrees F (i.e., producing the pre-conditioned air) using the cooling coil 121 and the desiccant 122. The pre-conditioned air is then distributed to the heating/humidification subsystem 130 where the temperature level is increased to 120 degrees F and the humidity level is increased to 30% relative humidity (i.e., producing the controlled air).

When the pre-conditioned air enters the heating/humidification subsystem 130, the dry pre-conditioned air is heated by the heating coil 131. Next, the airflow splitter 132 splits the heated air into two paths of heated, yet dry, air. One path goes directly to the air combiner 134 as heated/dry air. The other path goes through the humidification chamber 133 and then to the airflow combiner 134. The air out of the humidification chamber may be at 100% relative humidity, for example. At the airflow combiner, the dry/heated air from the one path is blended with the humidified/heated air from the other path in such a ratio so as to produce the controlled air at the desired specified humidity level (e.g., 30% RH) at the specified temperature level (e.g., 120 degrees F). In other words, the airflow combiner 134 acts to modulate both the humidified stream of air and the dry stream of air.

The controlled air is passed to the microwave oven 140 such that the panel having the film of wet paint is exposed to the controlled air. As a result, thermal energy is transferred from the controlled air to the film of wet paint which starts to dry the outer surface of the film of wet paint. The controlled air is exhausted out of the microwave oven 140 through, for example, a vent. The specified temperature level, the specified humidity level, the specified air flow rate, and the formula of the wet paint all factor into how the wet paint will dry. The sensors 150 feed back temperature, humidity, and air flow information to the system controller 160 such that the system controller 160 is able to adapt the heating/humidification subsystem 130 and/or air blower 110, if necessary, to maintain the controlled air to the microwave oven 140 at the specified temperature level, the specified humidity level, and the specified air flow rate. In accordance with an embodiment of the present invention, the controlled air is provided to the microwave oven 140 for a specified time period. In accordance with an alternative embodiment of the present invention, the controlled air may be provided to the microwave oven 140 for a first specified time period, and later for a second specified time period, for example. Other combinations of providing controlled air over various specified time periods are possible, as well.

The system controller 160 turns on the microwave source within the microwave oven 140 and controls the power level of the microwave energy provided by the microwave source as well as at least one specified time duration for producing the microwave energy. For example, the system controller may adjust the power level of the microwave source to 25% of the full 1500 watt power capability of the microwave source (i.e., 375 watts) which is to be applied for 180 seconds. The microwave energy is supplied to the interior chamber (i.e., energy transfer chamber) of the microwave oven 140 and irradiates the film of wet paint on the panel within the microwave oven chamber. As a result, the microwave energy is being used to vibrate water molecules within the interior of the film of wet paint (i.e., create thermal energy within the film of wet paint), attempting to dry the film of wet paint from the inside out. This is in contrast to the controlled air which is drying the film of wet paint from the outside in.

By controlling the parameters (i.e., temperature, humidity, flow rate, time period) of the controlled air, and by controlling the parameters (power level, time duration) of the microwave energy, the film of wet paint may be dried (i.e., removed of moisture) in a controlled and accelerated manner without having the film crack or bubble as it dries. As a result, the resultant true dried color of the paint may be achieved more quickly, consistently, and reliably than by other traditional methods.

Figure 3:
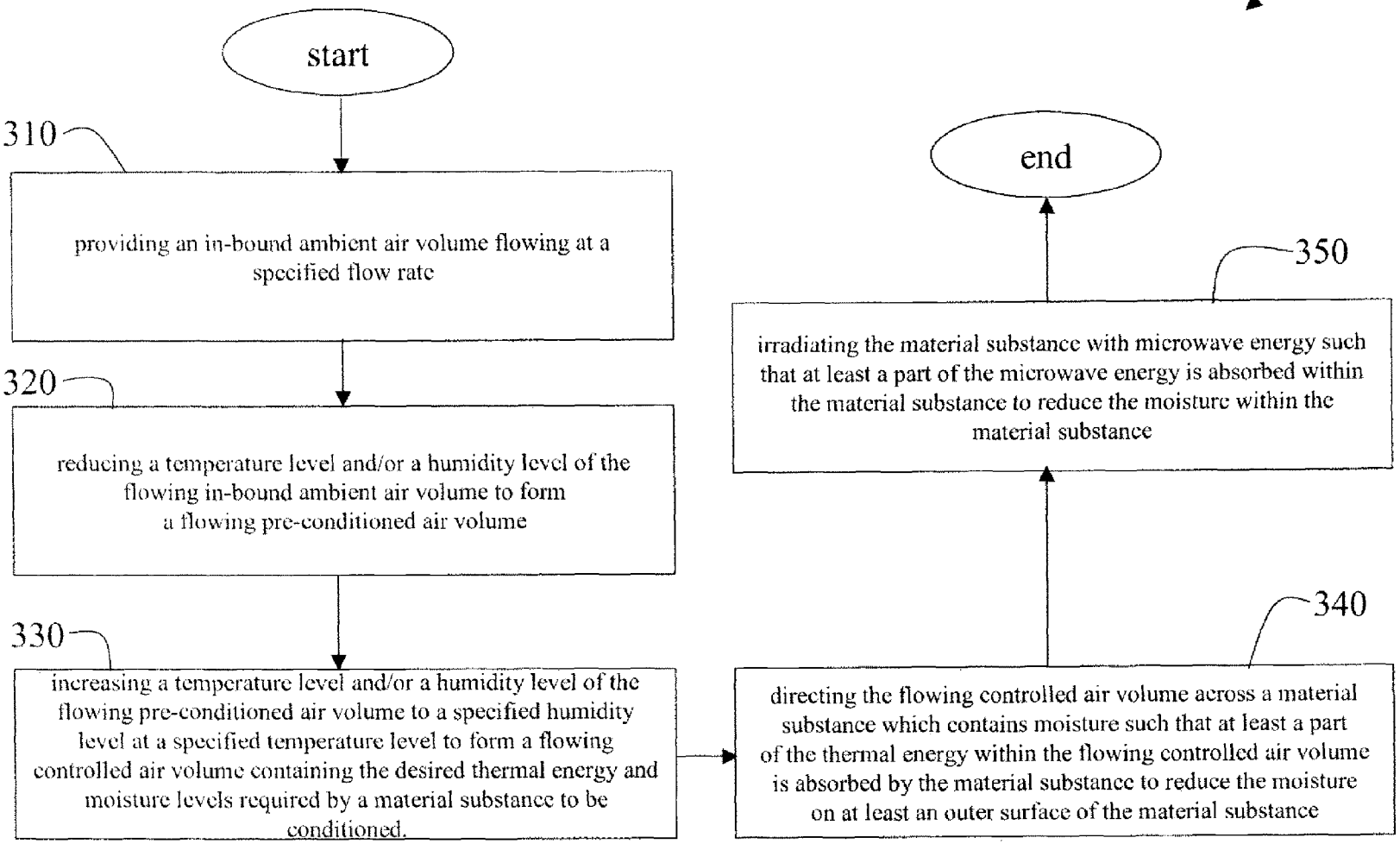
FIG. 3 is a flowchart of an exemplary embodiment of a method of controlling energy that is input to a material substance using the system of FIG. 1, in accordance with various aspects of the present invention.

FIG. 3 is a flowchart of an exemplary embodiment of a method 300 of controlling energy that is input to a material substance using the system 100 of FIG. 1, in accordance with various aspects of the present invention. In step 310 an in-bound ambient air volume is provided at a specified flow rate. In step 320, a temperature level and/or a humidity level of the flowing in-bound ambient air volume are reduced to form a flowing pre-conditioned air volume. In step 330, a temperature level and/or a humidity level of the flowing pre-conditioned air volume are increased to a specified humidity level at a specified temperature level to form a flowing controlled air volume containing the desired thermal energy and moisture levels required by the material substance to be conditioned. In step 340, the flowing controlled air volume is directed across a material substance which contains moisture such that at least a part of the thermal energy within the flowing controlled air volume is absorbed by the material substance to reduce the moisture on at least an outer surface of the material substance. In step 350, the material substance is irradiated with microwave energy such that at least a part of the microwave energy is absorbed within the material substance to reduce the moisture within the material substance.

In accordance with various embodiments of the present invention, the sequence and duration of the applied controlled air flow and the applied microwave energy may vary. For example, in accordance with a first embodiment of the present invention, the controlled air flow volume may be applied to the material substance before and during the microwave irradiation step. In accordance with a second embodiment of the present invention, the controlled air flow volume may be applied to the material substance only before the microwave irradiation step. In accordance with a third embodiment of the present invention, the controlled air flow volume may be applied to the material substance before and during only a part of the microwave irradiation step. In accordance with a fourth embodiment of the present invention, the controlled air flow volume may be applied to the material substance before, during, and after the microwave irradiation step. Other embodiments with other sequence combinations are possible as well and will depend on the material substance (e.g., the formula of the paint) and the parameters of the air flow and microwave energy being used (temperature, humidity power, etc.).

The method 200 may be extended, in accordance with another embodiment of the present invention, by applying microwave energy at a first specified power level for a first specified time duration, and then applying microwave energy at a second specified power level for a second specified time duration. Microwave energy may then be applied at a third specified power level for a third specified time duration. Other embodiments with other microwave energy application combinations are possible as well.

In accordance with an embodiment of the present invention, the power level of the microwave energy provided by the microwave oven 140 may be varied continuously from, for example, 0 watts to 1500 watts under the control of the system controller 160. The power level may be remotely controlled either digitally or by an analog signal via the system controller 160. In accordance with an alternative embodiment of the present invention, the power level may be controlled locally at the microwave oven 140. Similarly, the time duration associated with any stage of power level may be remotely or locally controlled. For example, the system controller 160 may be programmed to provide several combinations of microwave energy peak power level and time duration.

In accordance with an embodiment of the present invention, the relative humidity of the controlled air out of the heating/humidification subsystem 130 may be varied continuously from, for example, 0% to 100% under the control of the system controller 160. The temperature of the controlled air out of the heating humidification subsystem 130 may be varied continuously from, for example, 80 degrees F to 150 degrees F under the control of the system controller 160. The air flow rate of the controlled air out of the heating/humidification subsystem 130 may be varied continuously from, for example, 50 to 300 CFM under the control of the system controller 160. In accordance with an alternative embodiment of the present invention, any or all of such parameters may be controlled manually, instead of via the system controller 160.

The accuracy of the various controlled parameters may vary, in accordance with various embodiments of the present invention. However, for the application of drying films of wet paint, temperature is typically controlled to within +/−2 degrees F and relative humidity is controlled to within +/−2% RH. In general, the system 100 may be totally programmable in order to control parameters for the drying of different material substances (e.g., different paint formulas).

Air flow may be provided within the system 100 entirely by the air blower subsystem 110, or may be provided by several fans, valves, and/or dampers located strategically throughout the system 100, in accordance with various embodiments of the present invention. In accordance with an alternative embodiment of the present invention, the air blower subsystem 110 may be located at the output of the heating/humidification subsystem 130 and act to suck air through the cooling/de-humidification subsystem 120 and the heating/de-humidification subsystem 130, and blow air into the microwave oven 140. Other alternate air flow/air handling embodiments are possible as well. Typically, the temperature of the ambient air into the cooling/de-humidification subsystem 120 is between 45 degrees F and 110 degrees F, for example, at between 0% to 100% relative humidity.

In accordance with an optional embodiment of the present invention, the system 100 may include a plurality of microwave ovens 140 such that multiple samples of material substances may be dried simultaneously. In such an optional embodiment, the system 100 is designed to provide enough positive airflow pressure out of the airflow combiner to accommodate the desired specified airflow rate to each of the microwave ovens.

Figure 4:
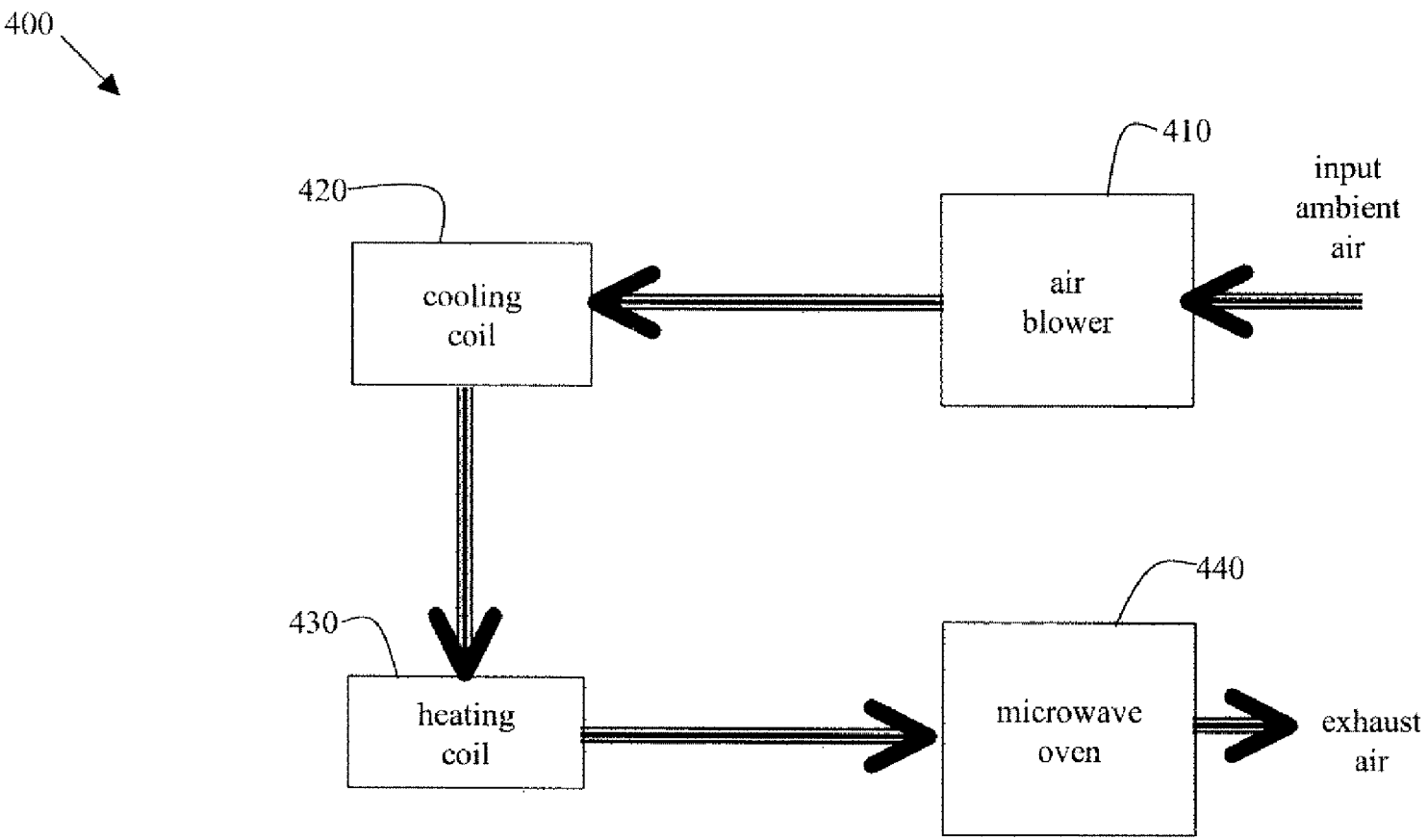
FIG. 4 illustrates a schematic block diagram of an exemplary alternate embodiment of a system for controlling energy that is input to a material substance, in accordance with various aspects of the present invention.

FIG. 4 illustrates a schematic block diagram of an exemplary, simplified, alternate embodiment of a system 400 for controlling energy that is input to a material substance, in accordance with various aspects of the present invention. The system 400 comprises an air blower 410, a cooling subsystem 420, a heating subsystem 430, and a microwave subsystem 440. The air blower 410 provides ambient air to the cooling subsystem 420. The air blower may comprise a simple fan, for example. The ambient air may be at a temperature level of, for example, 85 degrees F at 65% relative humidity.

The cooling subsystem 420 cools the ambient air down to a temperature level which produces a saturated air (e.g., 37 degrees F at 100% relative humidity). The cooling subsystem may include, for example, a refrigerant type cooling coil. The saturated air is provided to the heating subsystem 430 where the saturated air is heated to a specified temperature level to achieve a specified relative humidity level (e.g., 85 degrees F at 20% relative humidity), forming a controlled air. The heating subsystem 430 may comprise a simple electric heating coil, for example.

The controlled air is provided to the microwave subsystem 440. The microwave subsystem may comprise, for example, a simple microwave oven having a microwave energy source (e.g., a magnetron). When a material substance to be dried is placed within a chamber of the microwave subsystem 440, the controlled air blows over the material substance to begin drying the outer surfaces of the material substance. The microwave subsystem 440 also irradiates the material substance with microwave energy of a specified power level to begin drying an inner volume of the material substance. Such a simplified system 400 may be used when the specified temperature level and humidity level of the controlled air is desired to always be the same (e.g., 85 degrees F at 20% relative humidity).

In accordance with various embodiments of the present invention, the methods and system described herein may be used to remove moisture from other material substances, besides paint, in other applications. For example, the system and methods described herein may be used to remove moisture from glues or adhesives as part of an accelerated bonding process. As another example, the system and methods described herein may be used for effectively baking edible foodstuffs and other goods in an accelerated manner. Other applications are possible as well. Such various applications may be used to control various appearance characteristics of the material substance such as color, color gradient, surface uniformity, and surface smoothness/roughness, for example. Other characteristics may be controlled as well such as, for example, internal texture and density of the resultant material substance (e.g., when baking a cake or cooking a turkey). Furthermore, as another example, the system and methods described herein may be used to remove, any liquid from any temperature sensitive material that requires a very specific rate of liquid removal that is not possible by other thermal processes. The invention as described may be operated with specific gases containing specific vapor levels to affect the desired result by specifically tuning the microwave energy to a specific frequency unique to the liquid in question.

In summary, a system and method of controlling energy that is input to a material substance are disclosed for the controlled removal of moisture from the material substance. A combination of thermally heated and humidified air and microwave energy are used to input energy into a material substance (e.g., a film of wet paint) in order to provide accelerated drying (i.e., moisture removal) of the material substance. The system may be programmed to handle material substances of various formulations by controlling at least airflow temperature, airflow humidity, air flow rate, microwave energy power and exposure time.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method of controlling energy that is input to a film of paint for the controlled removal of moisture from the film of paint, said method comprising:

blowing a controlled air flow, said controlled air flow having a specified humidity level at a specified temperature level, across a film of paint, wherein said film of paint exists on a surface, at a specified air flow rate over at least one specified time period such that said film of paint absorbs thermal energy from said controlled air flow via an outer surface of said film of paint, thereby causing said film of paint to lose moisture in a controlled manner;

exhausting said controlled air flow as said controlled airflow blows across said film of paint; and irradiating said film of paint with microwave energy at a first specified power level for at least a first specified time duration such that said film of paint absorbs at least a part of said microwave energy and converts said absorbed microwave energy to thermal energy within said film of paint, thereby causing at least an internal volume of said film of paint to lose moisture in a controlled manner.

2. The method of claim 1 further comprising irradiating said film of paint with microwave energy at a second specified power level for a second specified time duration such that said film of paint absorbs at least a part of said microwave energy and converts said absorbed microwave energy to thermal energy within said film of paint, thereby causing at least said internal volume of said film of paint to lose additional moisture in a controlled manner.

3. The method of claim 2 further comprising irradiating said film of paint with microwave energy at a third specified power level for a third specified time duration such that said film of paint absorbs at least a part of said microwave energy and converts said absorbed microwave energy to thermal energy within said film of paint, thereby causing at least said internal volume of said film of paint to lose still additional moisture in a controlled manner.

4. The method of claim 1 wherein said step of blowing said controlled air flow occurs before and during said entire microwave irradiation step.

5. The method of claim 1 wherein said step of blowing said controlled air flow occurs only before said microwave irradiation step.

6. The method of claim 1 wherein said step of blowing said controlled air flow occurs before and during only a part of said microwave irradiation step.

7. The method of claim 1 wherein said step of blowing said controlled air flow occurs before, during, and after said microwave irradiation step.

8. The method of claim 1 wherein a color appearance of said film of paint is affected by said removal of moisture from said film of paint.

9. A system for controlling energy that is input to a film of paint for the controlled removal of moisture from the film of paint, said system comprising:

a cooling/de-humidification subsystem for accepting ambient air and for decreasing a temperature level and a humidity level of said ambient air to produce a relatively dry and cool pre-conditioned air;

a heating/humidification subsystem operationally connected to said cooling/de-humidification subsystem to accept said pre-conditioned air and to add thermal energy and moisture to said pre-conditioned air to produce a controlled air having a specified humidity level at a specified temperature level;

an energy transfer chamber operationally connected to said heating/humidification subsystem to accept said controlled air such that said controlled air passes across a film of paint within said energy transfer chamber and transfers thermal energy from said controlled air to said film of paint, thereby causing an outer surface of said film of paint to lose moisture in a controlled manner; and a variable power microwave source operationally connected to said energy transfer chamber to provide microwave energy into said energy transfer chamber such that said film of paint may absorb at least a part of said microwave energy and convert said absorbed microwave energy to thermal energy within said film of paint, thereby causing at least an internal volume of said film of paint to lose moisture in a controlled manner.

10. The system of claim 9 further comprising an air blower subsystem operationally connected to said cooling/de-humidification subsystem to blow said ambient air into said cooling/de-humidification subsystem at a specified flow rate.

11. The system of claim 10 further comprising a system controller operationally connected to at least:

said air blower subsystem to control at least one of a fan speed and a damper setting of said air blower subsystem;

said heating/humidification subsystem to control a temperature level and a humidity level of said controlled air; and said variable power microwave source to control a power level and a time duration of said microwave energy.

12. The system of claim 9 wherein said cooling/de-humidification subsystem comprises:

a cooling coil; and a desiccant.

13. The system of claim 9 wherein said heating/humidification subsystem comprises:

a heating source;

an airflow splitter;

a humidification chamber; and and airflow combiner.

14. The system of claim 9 wherein said variable power microwave source and said energy transfer chamber constitute a microwave oven.

15. The system of claim 9 further comprising at least one sensor operationally connected between said heating/humidification subsystem and said energy transfer chamber to measure at least a temperature level and a humidity level of said controlled air, and said at least one sensor being operationally connected to said system controller to report said temperature level and said humidity level of said controlled air to said system controller.

16. The system of claim 13 further comprising a system controller operationally connected to at least said heating/humidification subsystem to control a blending of dry air from said airflow splitter and humidified air from said humidification chamber in said airflow combiner to form said controlled air being of said specified humidity level at said specified temperature level.

17. The system of claim 15 wherein said at least one sensor comprises a thermistor.

18. The system of claim 15 wherein said at least one sensor comprises a humidistat.

19. The system of claim 9 wherein said variable power microwave source comprises a magnetron.

20. The system of claim 13 wherein said heating source comprises an electric heating coil.

21. The system of claim 9 wherein a color appearance of said film of paint is affected by said removal of moisture from said film of paint.

22. A method of controlling energy that is input to a film of paint for the controlled removal of moisture from the film of paint, said method comprising:

providing an in-bound ambient air volume flowing at a specified flow rate;

reducing a temperature level and a humidity level of said flowing inbound ambient air volume to form a flowing pre-conditioned air volume at a first specified temperature level and a first specified humidity level;

increasing a temperature level and a humidity level of said flowing pre-conditioned air volume to a second specified humidity level at a second specified temperature level to form a flowing controlled air volume containing more thermal energy and moisture than said pre-conditioned air volume;

directing said flowing controlled air volume across a film of paint which contains moisture such that at least a part of said thermal energy within said flowing controlled air volume is absorbed by said film of paint to reduce said moisture of said film of paint; and irradiating said film of paint with microwave energy such that at least a part of said microwave energy is absorbed within said film of paint to reduce said moisture within said film of paint.

23. The method of claim 22 wherein said irradiating step is performed at a first specified power level of said microwave energy over a first specified time duration.

24. The method of claim 23 wherein said irradiating step is further performed at a second specified power level of said microwave energy over a second specified time duration.

25. The method of claim 24 wherein said irradiating step is further performed at a third specified power level of said microwave energy over a third specified time duration.

26. The method of claim 22 wherein the step of directing said flowing controlled air volume across said film of paint is performed before said step of irradiating said film of paint.

27. The method of claim 22 wherein the step of directing said flowing controlled air volume across said film of paint is performed before and during said step of irradiating said film of paint.

28. The method of claim 22 wherein the step of directing said flowing controlled air volume across said film of paint is performed before, during, and after said step of irradiating said film of paint.

29. The method of claim 22 wherein a color appearance of said film of paint is affected by said removal of moisture from said film of paint.

30. A system for controlling energy that is input to a film of paint for the removal of moisture from the film of paint, said system comprising:

a cooling subsystem for accepting ambient air and for decreasing a temperature level of said ambient air to produce a saturated air at a first specified temperature level at 100% relative humidity;

a heating subsystem operationally connected to said cooling subsystem to accept said saturated air and to add thermal energy to said saturated air to produce a controlled air having a second specified temperature level, which is higher than said first specified temperature level, at a specified relative humidity level which is lower than 100%;

an energy transfer chamber operationally connected to said heating subsystem to accept said controlled air such that said controlled air passes across a film of paint within said energy transfer chamber and transfers thermal energy from said controlled air to said film of paint, thereby causing an outer surface of said film of paint to lose moisture in a controlled manner; and a microwave source operationally connected to said energy transfer chamber to provide microwave energy into said energy transfer chamber such that said film of paint may absorb at least a part of said microwave energy and convert said absorbed microwave energy to thermal energy within said film of paint, thereby causing at least an internal volume of said film of paint to lose moisture in a controlled manner.

* * * * *

UNITED STATES PATENT AND TRADEMARK OFFICE

CERTIFICATE OF CORRECTION

PATENT NO. : 7,913,417 B2
APPLICATION NO. : 11/562593
DATED : March 29, 2011
INVENTOR(S) : John J. Patka, Sr. and Sharon L. Judge It is certified that error appears in the above-identified patent and that said Letters Patent is hereby corrected as shown below:

In the Specification,

Column 3, Line 48, delete "ill", and insert --#111--.

Signed and Sealed this
Second Day of June, 2015

Michelle K. Lee

Michelle K. Lee
*Director of the United States Patent and Trademark Office*